United States Patent [19]

Myun-Sik

[11] Patent Number: 4,735,522

[45] Date of Patent: Apr. 5, 1988

[54] PAINT ROLLER WITH INTERNAL RESERVOIR

[76] Inventor: Kim Myun-Sik, 290-11 Bukgaza-dong, Seodaemun-gu, Seoul, Rep. of Korea

[21] Appl. No.: 934,269

[22] Filed: Nov. 21, 1986

[30] Foreign Application Priority Data

Nov. 25, 1985 [KR] Rep. of Korea ..... 85-15466

[51] Int. Cl.[4] ..... B05C 1/08; B05C 1/10

[52] U.S. Cl. ..... 401/197; 401/208; 15/230.11

[58] Field of Search ..... 401/197, 208; D4/122; 15/230.11

[56] References Cited

U.S. PATENT DOCUMENTS

| | | | |
|---|---|---|---|
| 2,563,049 | 8/1951 | Liebelt et al. | 15/230.11 |
| 2,591,530 | 4/1952 | Findley | 401/197 |
| 2,916,755 | 12/1959 | Bozzay | 401/197 |
| 3,588,264 | 6/1971 | Mallindine | 401/197 |

*Primary Examiner*—Richard J. Apley
*Assistant Examiner*—Franklin Gubernick
*Attorney, Agent, or Firm*—Salter & Michaelson

[57] ABSTRACT

A painting roller for performing continuous painting work includes a roller element having an internal storage cylinder therein for receiving paint in the roller and at least one injection hole in an end of the roller element for filling the storage cylinder with paint, such as from a paint pail. A spring biased shutter is provided in the storage cylinder for closing the injection hole to prevent the inadvertent outflow of paint from the painting roller during painting work.

2 Claims, 5 Drawing Sheets

PAINT ROLLER WITH INTERNAL RESERVOIR

BACKGROUND AND SUMMARY OF THE INVENTION

The present invention relates generally to a painting roller for performing continuous painting work and more particularly to a painting roller having a permeable roller element with an internal storage cylinder therein, and an injection hole in an end of the roller element for filling the storage cylinder with paint by dipping the roller element into a pail of paint. Further, the roller includes a shaft which defines the axis of rotation of the roller element and extends through the roller element and outwardly from an end thereof merging into a handle, a movable pin which projects outwardly from the end of the roller element from which the shaft extends and outwardly beyond the shaft, a spring which biases the pin outwardly, a shutter which closes the injection hole, and a spring which biases the shutter to a closed position. In order to fill the storage cylinder with paint, the roller element is inserted into a pail of paint, and the pin is pressed against the wall of the pair to open the shutter.

Heretofore paint rollers have been available which have comprised a perforate hollow cylinder element having a cloth or fur covering wherein the interior of the cylindrical element is utilized as a storage cylinder for paint and wherein an injection hole is provided for filling the storage cylinder. However, it has been found that when rollers of this type have been used for rolling paint on the surfaces of walls, paint can inadvertently pass outwardly through the injection holes and must be cleaned up after the painting operation has been completed. In order to overcome this problem, the device disclosed in Korean Utility Model Application (Publication #85-1923 dated Sept. 11, 1985) included a shutter to shut off the injection hole thereof. However, it was found that because a portion of the shutter projected outwardly beyond the free end of the roller, the projecting portion of the shutter often engaged the adjacent wall when the roller was used to paint a corner, and that as a result the corner had to be repainted with a brush after painting work with the roller was completed.

It is therefore and object of the present invention to provide a painting roller having a storage cylinder around the axis of rotation of the roller element thereof and an injection hole in the roller element wherein the injection hole faces a curved portion of the handle of the roller element adjacent to where it is attached to an end of the roller element and wherein the roller includes a movable drive pin which is biased by a spring mounted on the axis of the roller element and is operable for opening the injection hole when the drive pin is urged against a wall of a paint pail to fill the storage cylinder.

Another object of the present invention is to provide a painting roller which is operable for performing continuous painting work on the corner of a wall without being interfered with by the outflow of paint from the roller so that hand brushing after the rolling operation is completed is unnecessary.

A still further object of the instant invention is to provide a painting roller which is operable for evenly distributing paint on a surface with the help of a cloth cover on the roller.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contempleted for carrying out the present invention.

DESCRIPTION OF THE INVENTION

Figure 1:
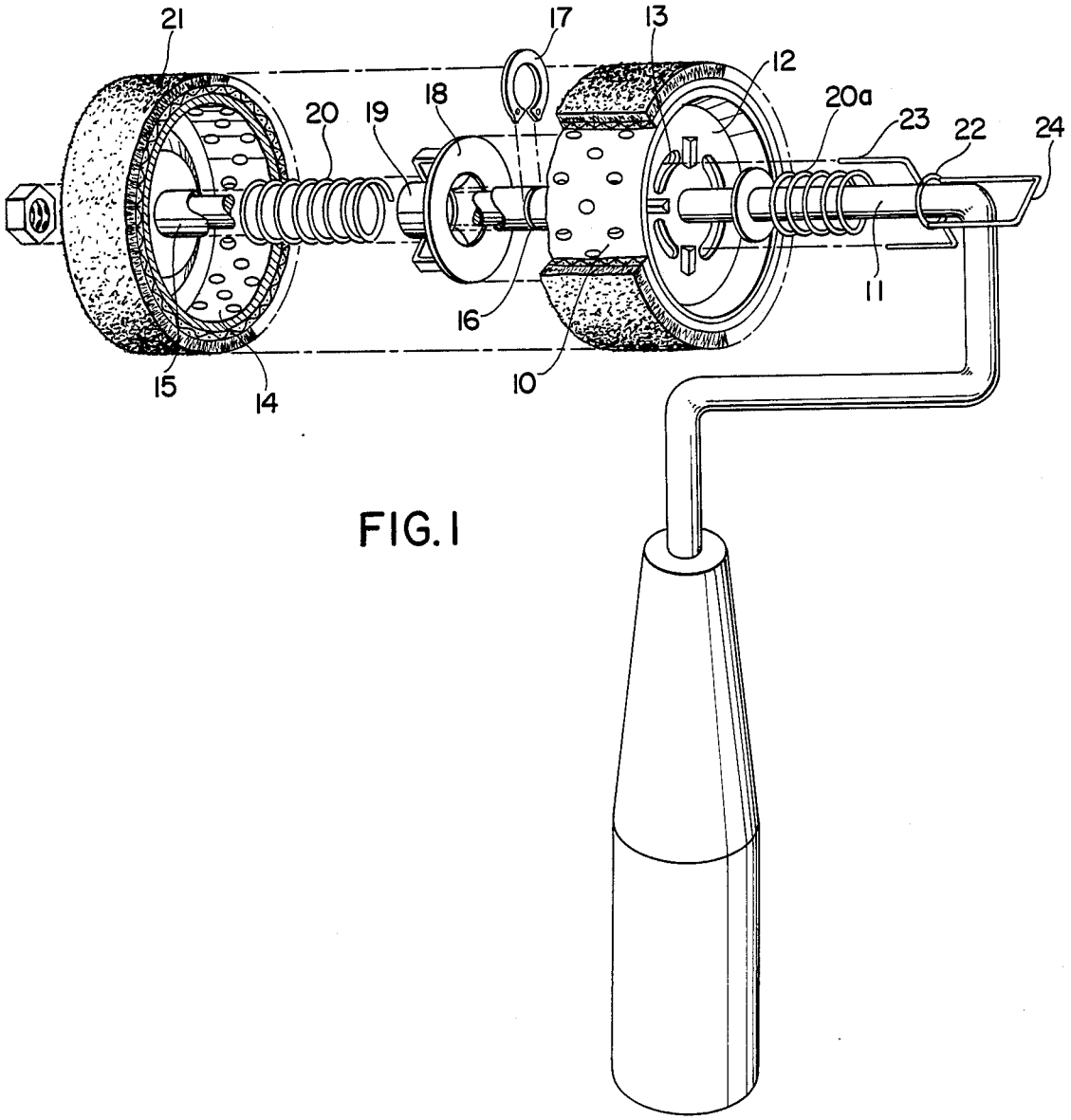
FIG. 1 is an exploded perspective view of a first embodiment of the painting roller of the instant invention.
Figure 2:
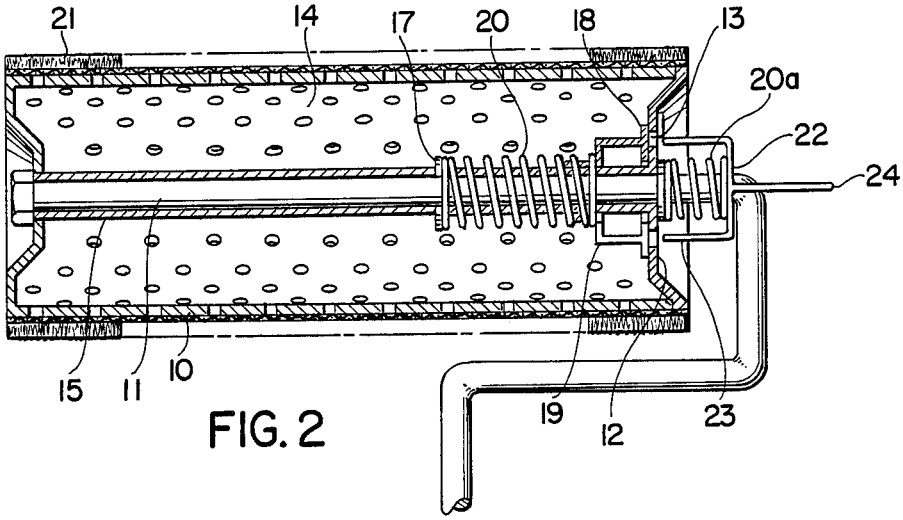
FIG. 2 is a cross-sectional view thereof wherein the shutter is in the closed position.
Figure 3:
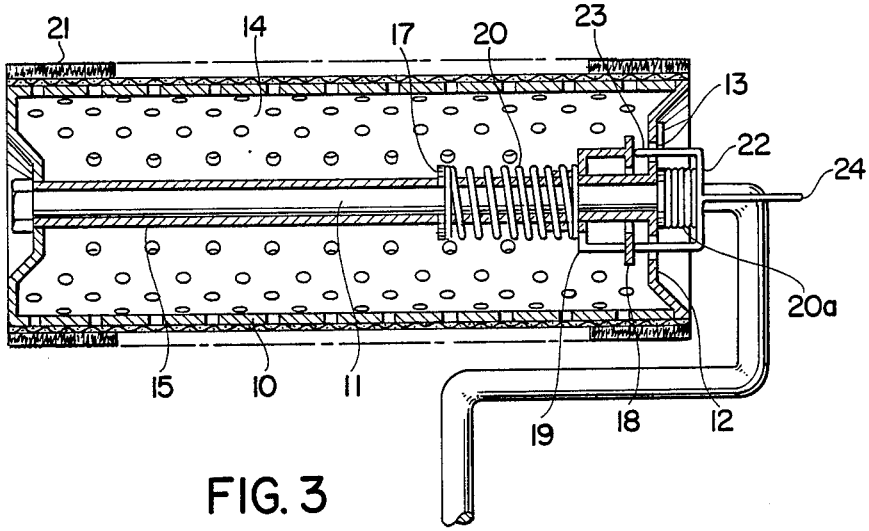
FIG. 3 is a cross-sectional view thereof wherein the shutter is in an open position.
Figure 4:
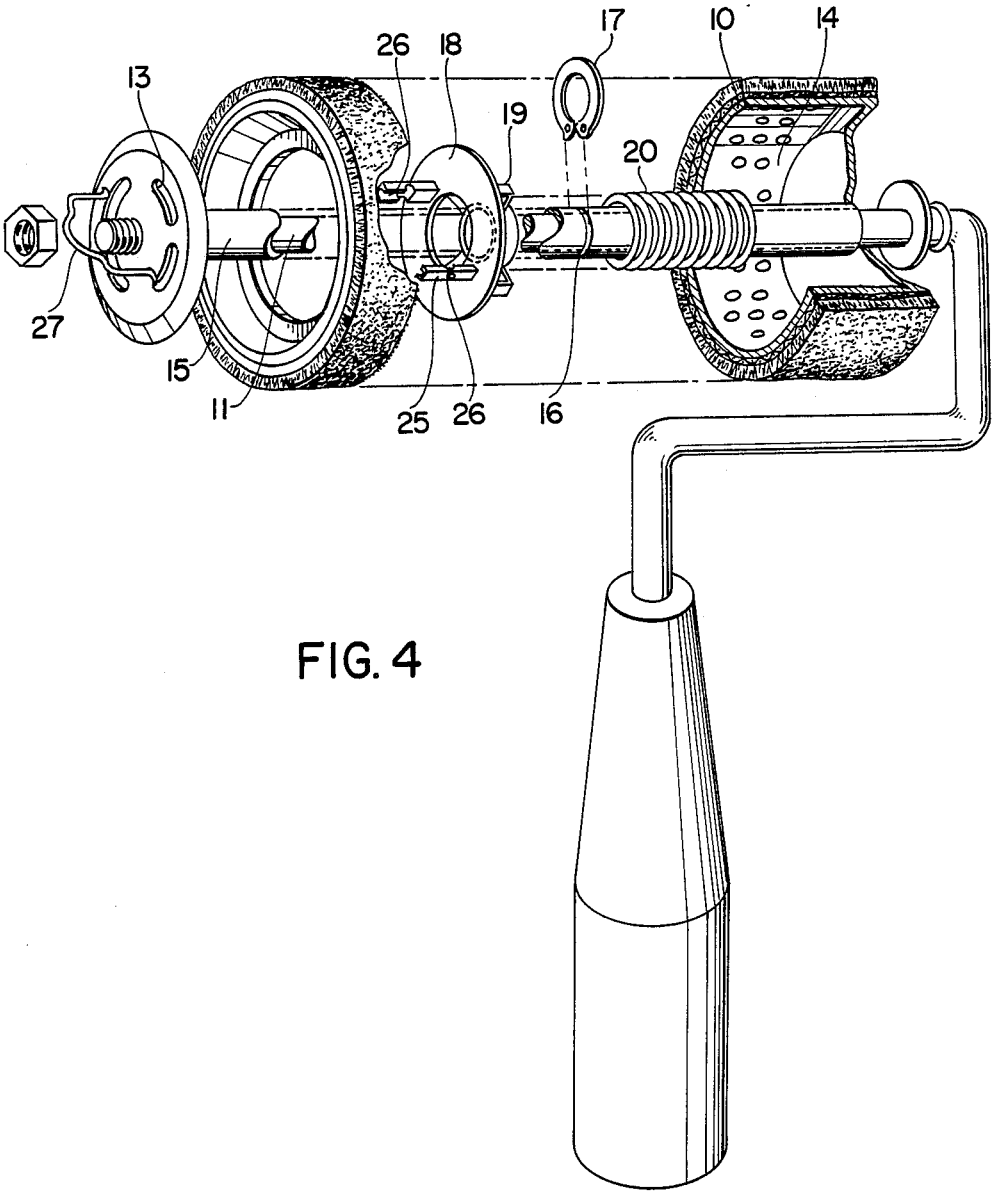
FIG. 4 is an exploded perspective view of another embodiment of the painting roller.
Figure 5:
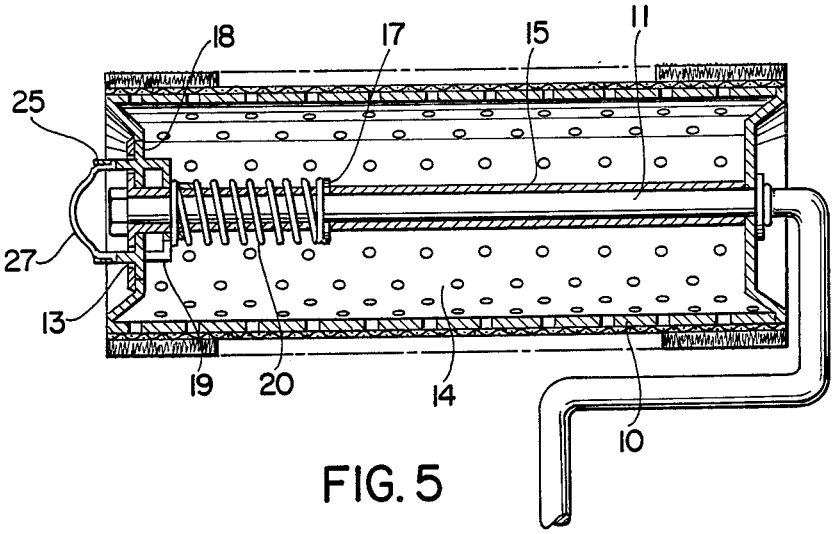
FIG. 5 is a cross-sectional view thereof wherein the shutter is in the closed position.
Figure 6:
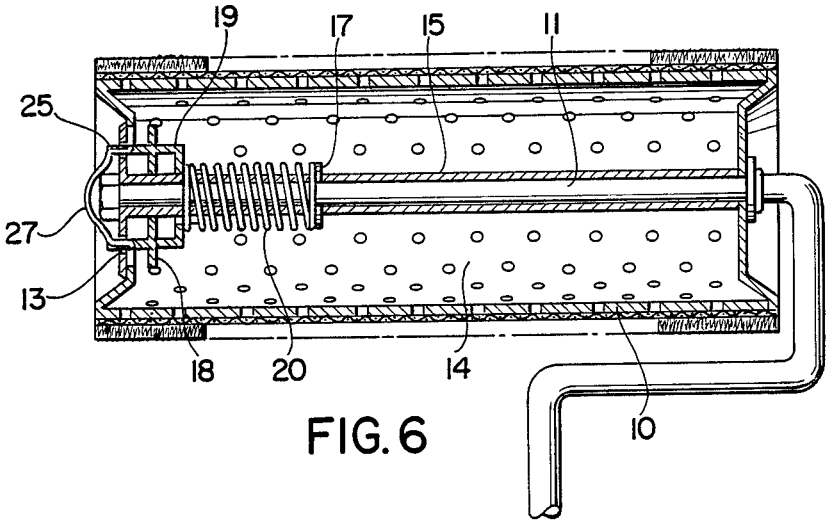
FIG. 6 is a cross-sectional view thereof wherein the shutter is in an open position.
Figure 7:
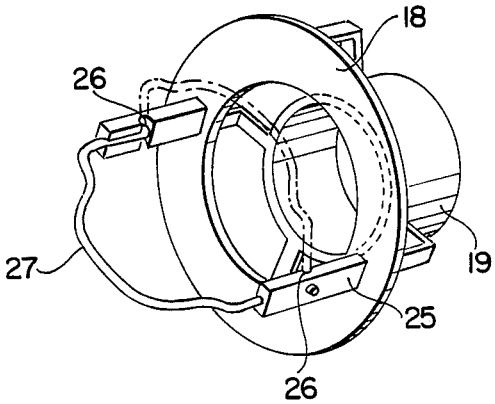
FIG. 7 is a fragmentary perspective view thereof with the wire projection of the roller in a folded-over position.

A first embodiment of the painting roller of the subject invention is illustrated in FIGS. 1 through 3 and indicated at 10. The roller 10 is constructed so that it includes a rotatable roller element and a movable portion which is disposed adjacent the righthand or connected end 12 of the roller element as the roller is illustrated in the drawings. A plurality of oblong holes 13 are formed in the roller element adjacent the right-hand or connected end thereof, and a shaft 11 is provided which defines the rotating axis of the roller element. The roller 10 includes a pipe or sleeve 15 which is received on the shaft 11 and has an annular groove 16 therein, and a pin or clip 17 is received in the groove 16. The interior of the roller element defines a storage cylinder 14, and a support 19 of a shutter 18 is received on the pipe 15 in the storage cylinder 14 and is biased by a spring 20 to a position wherein the shutter 18 closes the oblong holes 13 to prevent the outflow of paint from the cylinder 14. The roller 10 is, however, constructed so that paint can pass outwardly to a cloth brush or covering 21 through apertures in the circumferential surface of the roller element.

The shaft 11 extends outwardly from an end of the roller element, and it has a bend therein where it merges with a handle of the roller 10. Disposed outboard of the roller element on the shaft 11 is a projecting pin 23 of a movable part 22 which engages the shutter 18 through the holes 13, and a spring 20A biases the movable part 22 outwardly and away from the shutter 18. A wire outward drive pin 24 extends outwardly beyond the end of the roller element and beyond the bend in the shaft 11 where the shaft 11 merges into the handle portion of the roller 10.

In order to fill the storage cylinder 14 with paint, the roller element portion of the roller is dipped into a pail of paint, and the drive pin 24 of the movable part 22 is pressed against the wall of the pail. This causes the inwardly projecting pin 23 of the movable part 22 to be moved inwardly so that it moves the shutter 18 inwardly into the storage cylinder 14. As a result, the shutter 18 is moved away from the oblong holes 13 so that paint can flow inwardly into the storage cylinder 14 as long as the shutter 18 is held in an open position. After the storage cylinder 14 has been filled with paint, the drive pin 24 can be released from engagement with the wall of the pail so that the pin 24 is returned to its original outwardly projecting position by the spring 20A. Similarly, as illustrated in FIGS. 2 and 3, the spring 20 which is disposed between the pin 17 and the support 19 of the shutter 18 moves the shutter 18 to a closed postion wherein it blocks the holes 13. Thereafter it is possible to perform continuous painting work with the roller 10 until the supply of paint in the cylinder 14 is exhausted. In this regard, because the oblong holes 13 and the movable part 22 are formed on the same end of the roller element from which the shaft 11 extends as it merges into the handle, even painting work on corners is possible without requireing additional finish painting work. In other works, it is possible to move the free end of the roller element along the adjacent wall of a corner without interfering with a painted surface on the adjacent wall.

A second embodiment of the roller of the subject invention is illustrated and generally indicated at 10′ in FIGS. 4, 5, 6 and 7. The roller 10′ has a roller element having oblong holes 13′ therein which are disposed at the opposite end of the roller 10′ from the holes 13 in the roller 10, i.e., they are disposed in the free end of the roller element of the roller 10′. The roller 10′ includes a shaft 11 having a pipe or sleeve 15′ thereon, and a round pin or clip 17 is received on the pipe 15′. A spring 20′ is received on the pipe 15′ so that it is interposed between a support 19′ of a shutter 18′ and the clip 17′. Accordingly, the shutter 18′ is biased to a position wherein it blocks off the oblong holes 13′. The roller 10′ includes a push pin 27 which extends through the holes 13′ and projects outwardly from the end of the roller 10′ adjacent the holes 13′. The push pin 27 has inner ends which are received in T-shaped grooves 26 and 26′ in a pair of projections 25 attached to the shutter 18′. The push pin 27 is assembled in the T-shaped grooves 26 and 26′ so that it can be moved between an erected position wherein it extends outwardly in a substantial axial direction from the end of the shaft 11′ or a folded-over position wherein it extends in substantially perpendicular relation to the shaft 11′. When the push pin 27 is in its erected position, it can be pressed against a wall of a paint pail in a manner similar to the push pin 24 of the roller 10 in order to fill the roller 10′ through the holes 13′. Thereafter when the push pin 27 is released, the spring 20′ on the pipe 15′ pushes against the clip 17′ to move the shutter 18′ to shut off the holes 13′. After the roller 10′ has been filled with paint in this manner, it can be used for continuous painting work until the supply of paint contained therein is exhausted. In this regard, in order to make the roller 10′ more suited for painting corner areas, the push pin 27 can be moved to its folded-over position so that it does not contact an adjacent surface when the roller element is moved along a surface of an inside corner.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A painting roller comprising a shaft defining an axis of said roller, said shaft merging into a handle and having a bend therein where it merges into said handle, a permeable cylindrical roller element mounted on said shaft for rotation about said axis and means cooperating with said roller element for defining a storage cylinder on said shaft, one end of said roller element having a filling hole therein for filing said storage cylinder and being disposed adjacent said bend, a shutter element mounted on said shaft in said storage cylinder and operable for blocking said roller element filling hole, spring means biasing said shutter element to a position wherein it blocks said roller element filling hole and projection means on said shaft adjacent said end of said roller element having said filling hole therein, said projection means extending beyond said shaft bend and being depressible for moving said shutter element away from said filling hole to permit the inflow of paint therethrough for filling said storage cylinder.

2. A painting roller comprising a shaft defining an axis of said roller, said shaft merging into a handle and having a bend therein where it merges into said handle, a permeable cylindrical roller element mounted on said shaft for rotation about said axis and means cooperating with said roller element for defining a storage cylinder on said shaft, one end of said roller element being disposed adjacent said shaft bend, the other end of said roller element having a filling hole therein for filling said storage cylinder, a shutter element mounted on said shaft in said storage cylinder and operable for blocking said roller element filling hole, spring means biasing said shutter element to a position wherein it blocks said roller element filling hole and projection means disposed adjacent said end of said roller element having said filling hole therein, said projection menas being alternatively positionable in an erected position wherein it extends outwardly from said end of said roller element having said filling hole therein in substantially parallel relation to said axis and wherein it is depressible for moving said shutter element away from said filling hole to permit the inflow of paint therethrough into said storage cylinder and folded-over position wherein it extends in substantially perpendicular relation to said axis.

* * * * *